US005209307A

United States Patent [19]

Hotte

[11] Patent Number: 5,209,307

[45] Date of Patent: May 11, 1993

[54] REAR MOUNTED GRADER FOR VEHICLES

[76] Inventor: Jean-Francois Hotte, 103, Emery-Belisle, Papineauville, Quebec, Canada, J0V 1R0

[21] Appl. No.: 900,441

[22] Filed: Jun. 18, 1992

[51] Int. Cl.[5] ..... E01H 5/04; A01B 59/042; A01B 63/02

[52] U.S. Cl. ..... 172/445.2; 172/684.5; 172/501; 37/268; 37/231; 37/236

[58] Field of Search ..... 172/445, 445.1, 445.2, 172/799.5, 501, 414, 449, 684.5; 37/231, 234, 235, 236, 268, DIG. 3

[56] References Cited

U.S. PATENT DOCUMENTS

| | | | |
|---|---|---|---|
| 3,008,251 | 11/1961 | Cline et al. | 37/235 |
| 3,252,523 | 5/1966 | Kachnik et al. | 172/445.2 |
| 3,598,186 | 8/1971 | Coontz | 37/234 |
| 3,640,005 | 2/1972 | Chiarolanza et al. | 37/236 |
| 3,800,447 | 4/1974 | Harvey | 37/236 |
| 4,369,590 | 1/1983 | Miller | 37/235 |
| 4,403,432 | 9/1983 | Brance | 37/235 |
| 4,907,357 | 3/1990 | Lilienthal | 37/236 |
| 5,046,271 | 9/1991 | Daniels | 37/236 |
| 5,058,295 | 10/1991 | Holland | 37/236 |

*Primary Examiner*—Randolph A. Reese
*Assistant Examiner*—Spencer Warnick
*Attorney, Agent, or Firm*—Roland L. Morneau

[57] ABSTRACT

A rear mounted grader for vehicles comprises a plate member adapted to be vertically secured to the vehicle frame behind the wheels. A pair of rearwardly extending arms are pivotally mounted on the plate member and are provided with a sliding member securely mounted between the arms. A grader blade is transversally disposed relative to the arms and is secured thereunder at the rear end thereof. A hydraulic piston is pivotally secured at one end to the plate member above the pair of arms and to the sliding member at the opposite end for raising and lowering the blade from a position above the ground to an abutting position with the ground, whereby upon actuation of the piston, the blade is adapted to selectively abut against the ground for grading the ground or be lifted therefrom. The grader is preferably provided with spring blades mounted behind the sliding member between the latter and the pair of arms. The sliding member is adapted to abut against the spring blades to allow the blade to resiliently abut the ground when the piston lowers the blade against the ground.

7 Claims, 6 Drawing Sheets

REAR MOUNTED GRADER FOR VEHICLES

BACKGROUND OF THE INVENTION

1. Field of the Invention

The invention relates to a grader for leveling the ground or for plowing snow. The grading implement is adapted to be mounted at the rear of a vehicle and more specifically at the rear of a truck for scraping the ground whether the ground is covered by earth, gravel, small rocks, snow or ice.

The grading blade according to the invention is supported from the vehicle along a horizontal axis and is pivotally moved around this axis by hydraulic piston and is resiliently maintained in contact with the ground by a mechanical spring arrangement. The supporting arrangement for the blade also contemplates a second horizontal axle for allowing the blade to pivot about a transversal axis relative to the longitudinal direction of the vehicle.

An alternative embodiment of the invention includes a pivoting arrangement which allows the blade to be angularly oriented relative to the direction of movement of the vehicle to allow the blade to laterally shed the surplus amount of ground or snow gathered by the blade.

2. Prior Art

U.S. Pat. Nos. 4,403,432 and 4,369,590 are directed to a rear mounted scraper blade for vehicles which is cable operated.

In U.S. Pat. No. 3,800,447 the scraper blade abuts against the ground through the action of a pulling hydraulic cylinder without the flexibility of a resilient mechanical spring.

SUMMARY OF THE INVENTION

The present invention is directed to a rear mounted grader for vehicles which are provided with a frame extending behind a pair of rear wheels. The grader comprises a plate member adapted to be vertically secured to the vehicle frame behind the wheels. A pair of rearwardly extending arms are pivotally mounted on the plate member and are provided with a sliding member securely mounted between the arms. A grader blade is transversally disposed relative to the arms and is secured thereunder at the rear end thereof. A hydraulic piston is pivotally secured at one end to the plate member above the pair of arms and to the sliding member at the opposite end for raising and lowering the blade from a position above the ground to an abutting position with the ground, whereby upon actuation of the piston, the blade is adapted to selectively abut against the ground for grading the ground or be lifted therefrom.

The grader is preferably provided with spring blades mounted behind the sliding member between the latter and the pair of arms. The sliding member is adapted to abut against the spring blades to allow the blade to resiliently abut the ground when the piston lowers the blade against the ground. According to a preferred embodiment of the invention, the plate member includes two superposed first and second plates. The first plate is vertical and secured to the vehicle frame while the second plate is pivotally supported on the first plate at the lower end thereof. The second plate is locked to the first plate in abutting relationship. The second plate is provided with a lateral slot parallel to the plates and with a cross-bar pivotally mounted on the second plate and extending through the slots. The arms are secured to the cross-bar and are adapted to pivot with the cross-bar about an axis perpendicular to the second plate. This arrangement allows the blade to tilt sideways according to the lateral difference in level of the ground.

The sliding member is supported by two transversal beams securely extending between the arms and longitudinal beams securely extending between the transversal beams. The longitudinal beams define a slit to receive an I-beam adapted to slide therethrough. A ball-joint member is secured over the I-beam for connecting the piston to the I-beam.

In order to prevent the arms and blade from vibrating when the grader travels with the blade in a retracted position, a rod pivotally mounted over one of the arms is adapted to rest against an abutting wall secured on the second plate. In this latter position, the rod is adapted to define a permanent angle with the second plate while the piston maintains a constant traction of the blade.

It is also an object of the present invention to provide a sandblasting device over and behind the grader. The sandblasting device is provided with a chute for receiving sand or the like from the vehicle and projecting it on the ground through a dispersing device immediately after the passage of the blade.

DETAILED DESCRIPTION OF THE INVENTION

Figure 1:
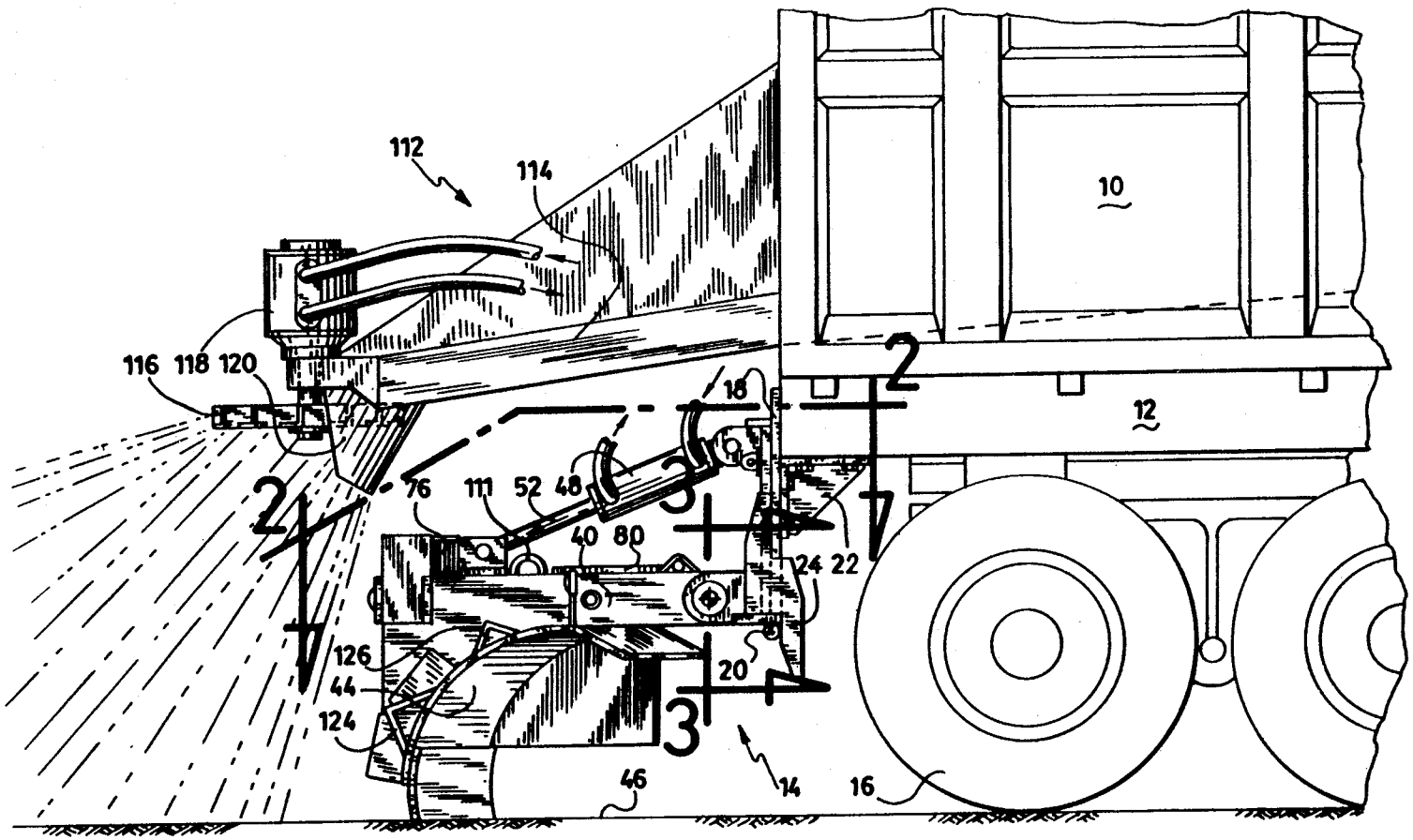
FIG. 1 is a side view of a grader according to the invention mounted behind a truck and below a sandblasting device.
Figure 2:
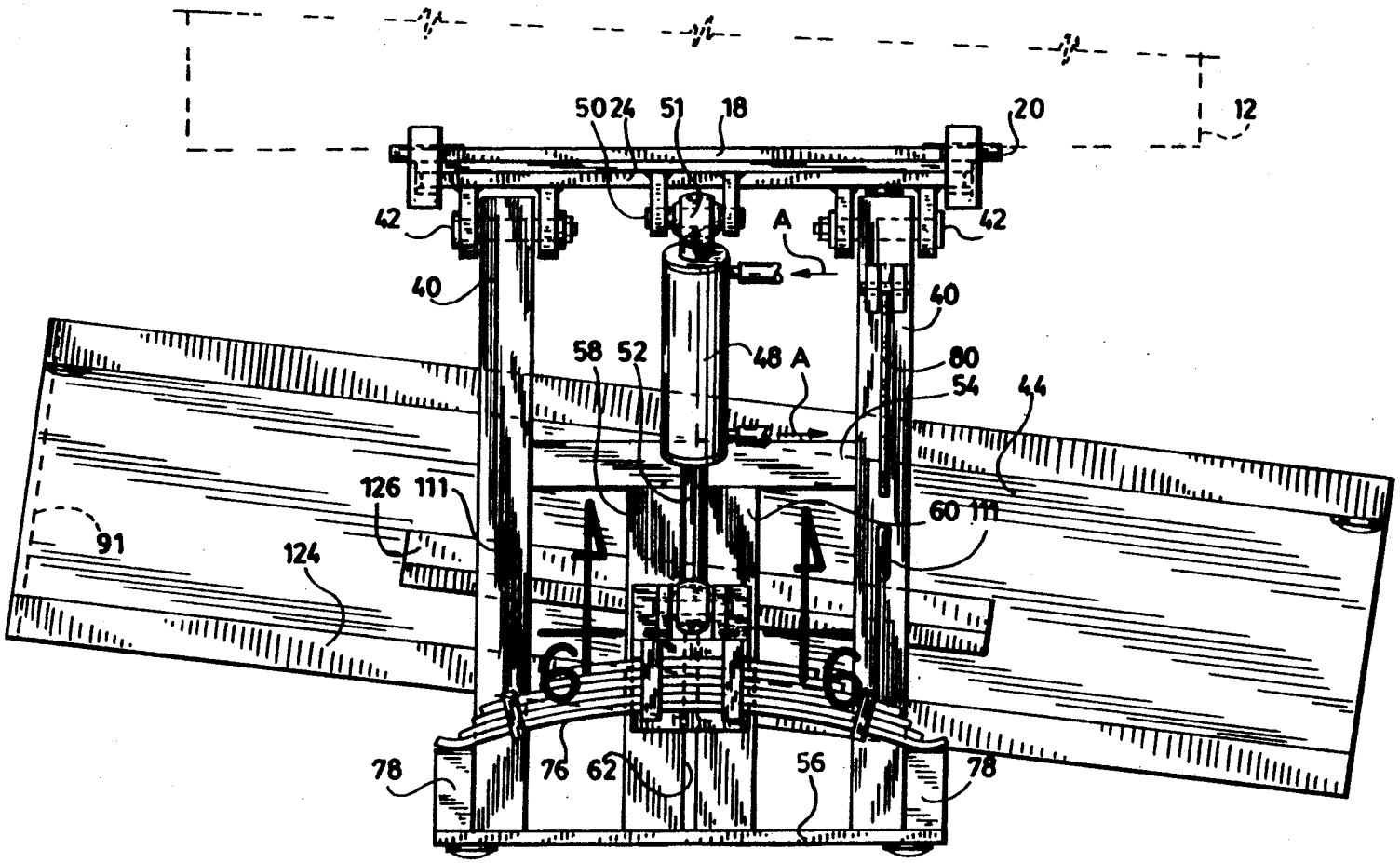
FIG. 2 is a top view of the grader along line 2—2 of FIG. 1.
Figure 5:
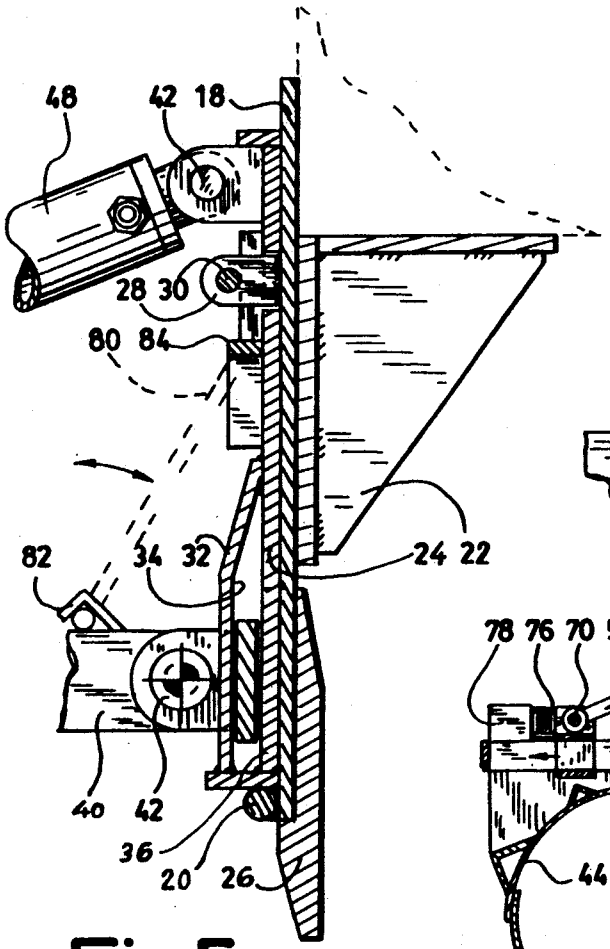
FIG. 5 is a cross-sectional view taken along line 5—5 of FIG. 3.

FIGS. 1 and 2 illustrate a truck 10 having a frame 12 on which is mounted a grader 14 behind rear wheels 16 of the truck. The grader 14 is secured to the frame 12 by a first plate 18 having a pair of laterally extending rods 20 welded at its lower end. The plate 18 is secured to the frame 12 by a right-angular plate 22 bolted under the frame 12 at its rear end behind the wheels 16. A second plate 24 having at its lower end a pair of legs 26 is supported by the lateral rods 20 extending under the lateral legs 26. The second plate 24 is mounted over the rods 20 in a pivoting action and is pushed against the first plate 18 and is held in contact therewith by a pair of ears 28 secured to the first plate 18 and extending through aligned apertures in the second plate 24 as shown in FIG. 5. The second plate 24 is locked in this position by a pair of pins 30 extending across the ears 28.

The second plate 24 is provided at its lower end with a pair of lateral double walls 32 spaced from the plate 24 to provide lateral slots 34 on the right and left sides of the plate 24. The slots 34 are used to retain both ends of a cross-bar 36 which is pivotally mounted about its center on an axle 38 which allows the cross-bar 36 to pivot and move vertically into the slots 34. A pair of arms 40 are pivotally mounted on the cross-bar 36 through axles 42 extending parallel to the second plate 24. The grader blade 44 is transversally secured to the arms 40 and generally welded thereto. The blade 44 is accordingly allowed to pivot about the axle 42 according to the difference of level of the ground 46.

A hydraulic cylinder 48 is pivotally mounted on the second plate 24 about an axle 50 through a ball joint 51. The cylinder 48 is secured to the plate 24 between the arms 40 and above the latter and is disposed to form a triangular configuration seen sideways with the arms 40 and the plate 24.

The piston 52 is pivotally connected to a sliding device secured between the two arms 40. A pair of transversal beams 54 and 56 are secured at each end to the arms 40. A pair of longitudinal beams 58 and 60 are secured at each end to the transversal beams 54 and 56 midway between the latter. The longitudinal beams 58 and 60 are spaced from each other to define a slit 62 and an I-shaped beam 64 is slidably mounted in the slit 62. The upper face 66 of the I-beam 64 is adapted to ride on the longitudinal beams 58 and 60 and is held thereagainst by the lower face 68 of the I-beam.

The I-beam 64 constitutes the essential element of the sliding device to which the piston 52 is connected through a ball joint 70. The ball joint 70 is rotatably mounted about an axle 72 onto flanges 74 secured to the upper face 66 of the I-beam 64. When the cylinder 48 is hydraulically actuated by a hydraulic fluid along the arrows A, piston 52 is adapted to slide in and out of the cylinder 48 in order to raise and lower the blade 44. In the position shown in FIG. 1, the blade 44 has been lowered to rest against the ground 46 while in FIG. 1*a* the piston 52 has been retracted to raise the blade 44 to a suitable level above the ground 46 to prevent any contact with the latter when the truck is travelling while the blade 44 is inoperative. As it can be seen from both FIGS. 1 and 1*a*, the arms 40 are simultaneously pivoted about the axle 42. The sliding device and in particular the I-beam 64 is adapted to slide through the slit 62 to adapt to the shrinking triangular configuration formed by the cylinder 48, the arm 40 and the plate 24.

Figure 7A:
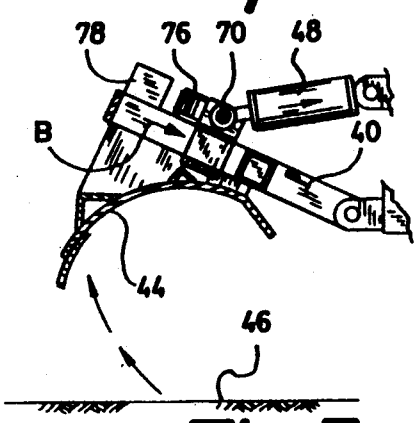
FIG. 7*a* is a view similar to FIG. 7 with the grader in a raised position.
Figure 7:
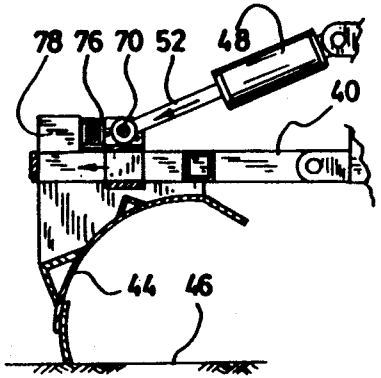
FIG. 7 is a cross-sectional view taken along line 7—7 of FIG. 6.

In order to prevent a complex arrangement for supplying the hydraulic fluid to the cylinder 48 which would provide a continuous adjustment of the blade 44 corresponding to the level of the ground 46, a plurality of spring blades 76 are mounted on the sliding device and particularly secured in front thereof and extending over the arms 40. Both ends of the spring blade 76 are adapted to abut against bumper elements 78 secured over the arms 40 adjacent the transversal beam 56. As may be seen from FIGS. 7 and 7*a*, when the piston 52 is extended, the sliding device, characterized by the ball joint 70 in FIG. 7, causes the spring blade 76 to abut against the bumper element 78 and accordingly take up any small difference in level of the road while the cylinder 52 remains extended at a predetermined length. With this arrangement, the piston 52 does not have to permenantly adjust to all the small differences in levels of the ground 46. However, when the piston 52 is retracted as shown in FIG. 7*a*, the blade 44 is raised and the spring blades 76 are pulled away from the bumper elements 78 in the direction of the arrow B. As more specifically shown in FIG. 9, when the ground has a difference in level as shown by arrow C the blade 44 lowers by a suitable amount. Such a lowering of the blade 44 does not have to be compensated by the piston 52 while its retraction changes in the direction of the arrow B (see FIG. 7*a*). Under this condition, the distance S of the sliding device (see FIG. 9) from the bumper element 78 increases but is picked up by the extension of the spring blades 76. Such an arrangement allows the blade 44 to be maintained in constant and reliable abutment against the ground 76.

Figures 1A, 3, 4:
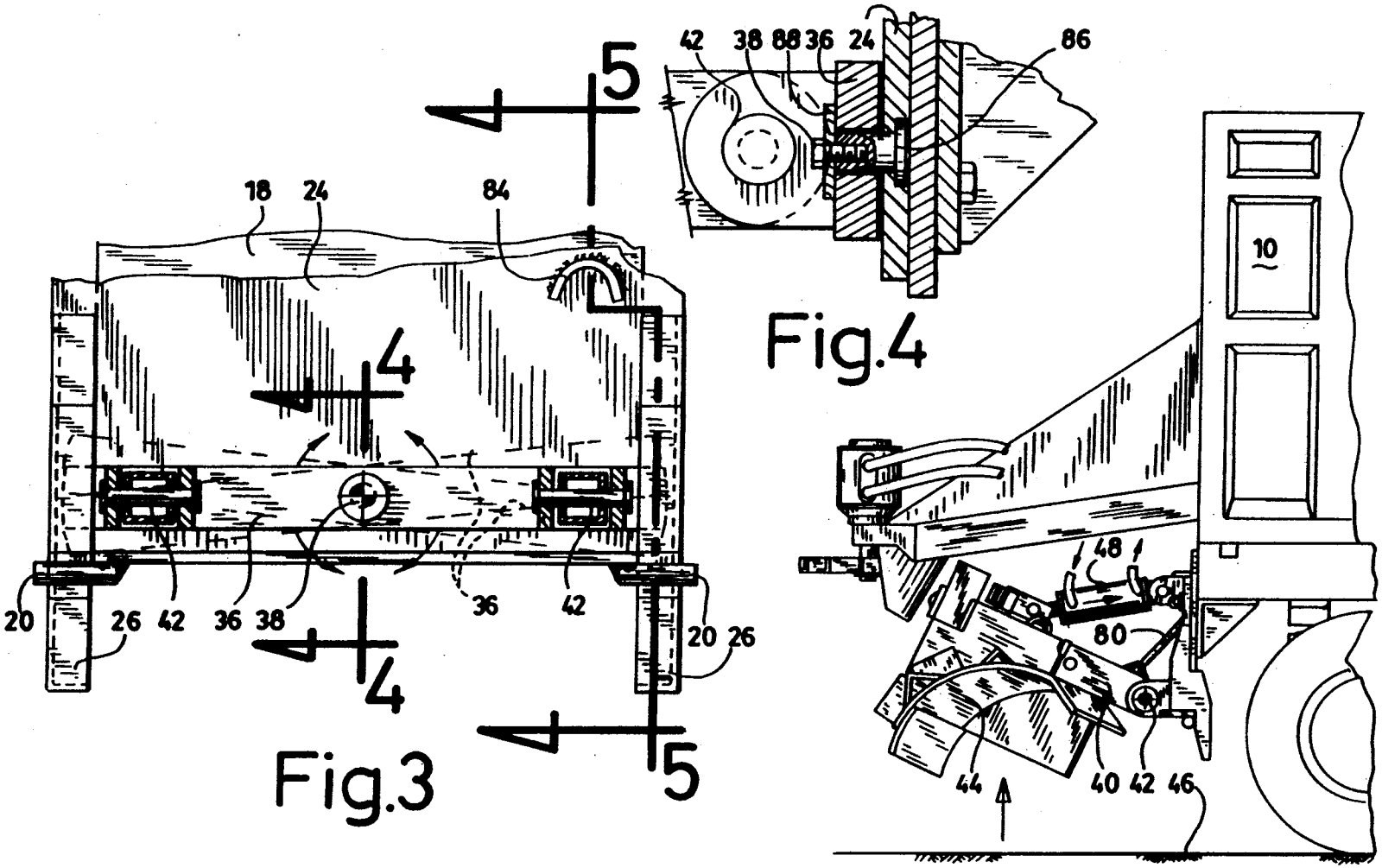
FIG. 1*a* is a side view as shown in FIG. 1 with the grader lifted in an unoperative position.
FIG. 3 is a cross-sectional view taken along line 3—3 of FIG. 1.
FIG. 4 is a cross-sectional view taken along line 4—4 of FIG. 3.
Figure 9:
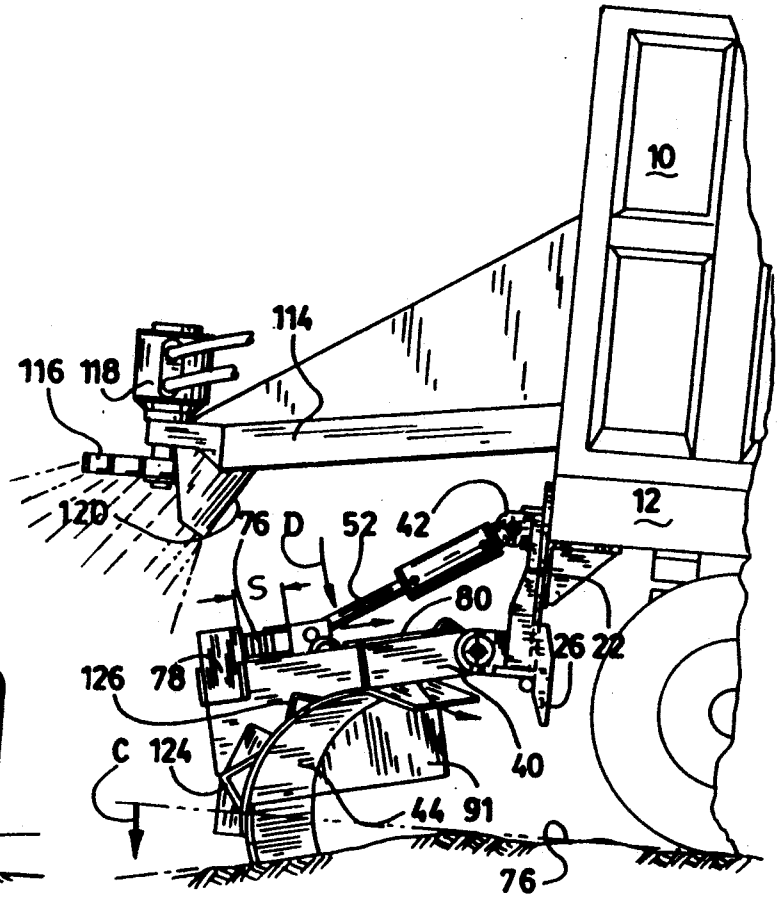
FIG. 9 is a side view of the grader operating on a slightly hilly road.

Another characteristic of the invention allows the blade 44 to travel in its raised position as shown in FIG. 1*a* while preventing the blade 44 from vibrating relative to the truck 10. When the truck 10 travels and the grader is not needed, the cylinder 48 retracts the piston 52 and raises the blade 44, via the sliding member abutting the forward transverse member 54, up to a position determined by an abutment arrangement provided by a rod 80 pivotally mounted on the upper surface of one of the arms 40. The rod 80 has an L-shape having a portion extending under a hook member 82 which allows the rod 80 to pivot from a position which is flat against the arm 40 as shown in FIG. 9, to a position angularly resting against the plate 24 as particularly shown in FIG. 1*a*. The rod 80 is restricted from sliding upwardly against the surface of the plate 24 by an abutting roof 84 particularly shown in FIGS. 3 and 5. The rod 80 as shown in FIG. 1*a* prevents the blade 44 from moving upwardly beyond a predetermined angle while the cylinder 48 prevents it from lowering and prevents the rod 80 to be disengaged from the abutting roof 84.

Figure 8:
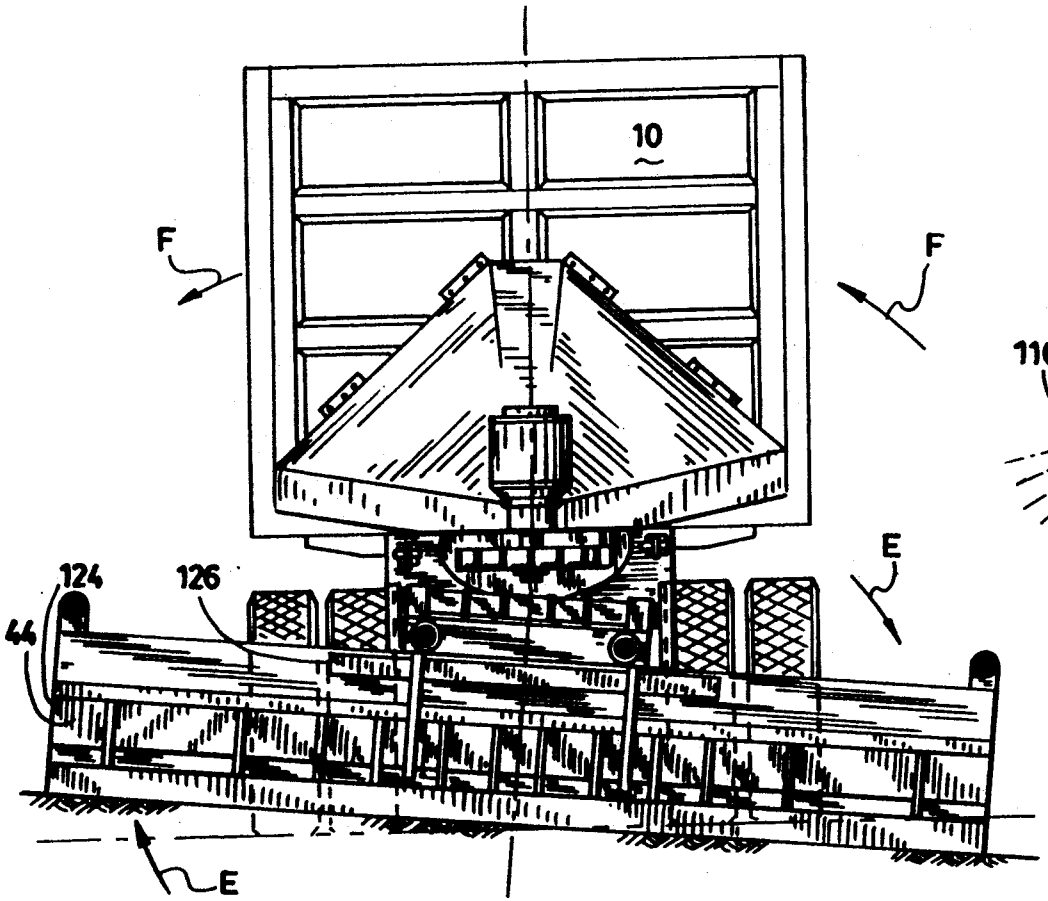
FIG. 8 is a rear view of the grader in a transversally tilted position relative to the horizontal surface of the ground, the grader being mounted behind a truck with a sandblasting device mounted above.

As shown in FIG. 8, the blade 44 is adapted to tilt laterally along the arrow E in order to follow the transversal inclination of the ground or to compensate for the inclination of the truck along the arrows F. Such a compensation is provided by the axle 38 extending through the cross-bar 36 and the plate 24. An internally threaded sleeve 86 extends through the plate 24 and the cross-bar 36 and is retained thereinto by a washer 88 and the axle 38. Both arms 40 are consequently allowed to pivot about the axle 38 to allow the blade 44 to take up the angles such as illustrated by arrows E in FIG. 8.

The blade 44 is provided with reinforcing ribs 124, 126 along a portion of the length of the blade and with a deflecting plate 91, particularly shown in FIGS. 2 and 9 for preventing the snow or the earth to move in a non-desirable direction, that is, away from the suitable direction provided by the inclination of the grade as shown in FIG. 2.

Figure 6:
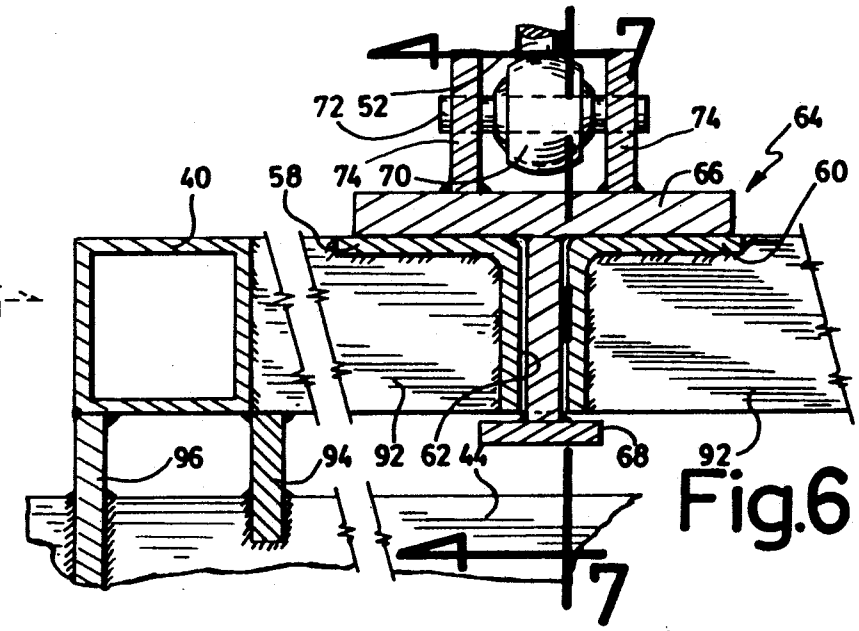
FIG. 6 is a cross-sectional view taken along line 6—6 of FIG. 2.

As particularly illustrated in FIG. 6, the longitudinal beams 58 and 60 are preferably L-shaped supported by transversal beams 54, 56 and beam 54 is secured to the blade 44 by a set of upstanding beams such as 94 and 96.

Figure 10:
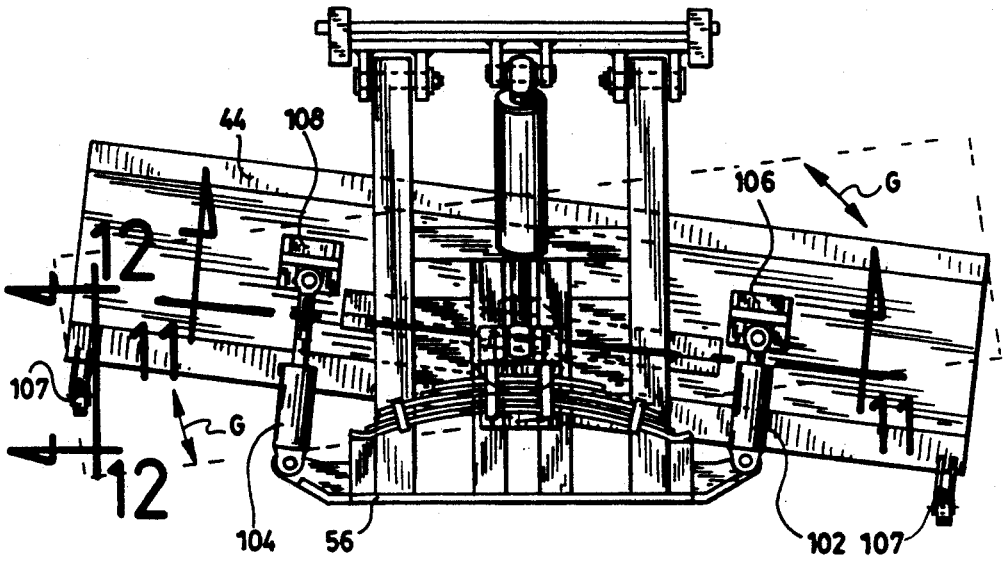
FIG. 10 is a top view of an alternative embodiment of the grader provided with a pair of pistons to alter the crosswise direction of the blade.
Figure 11:
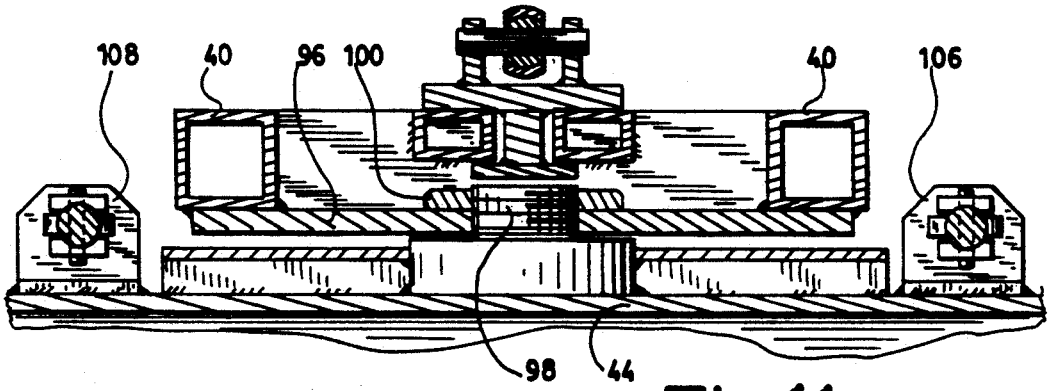
FIG. 11 is a cross-sectional view taken along the line 11—11 of FIG. 10.

An arrangement for changing the angle of the blade 44 relative to the direction of the road is illustrated in an alternative embodiment shown in FIGS. 10 and 11. The blade is pivotally mounted to a truss beam 96 secured at both ends to the arms 40. The blade 44 is pivotally mounted to the truss beam 96 through a threaded hub 98 held thereto by a washer 100. The adjustment along the angle G is provided by a pair of hydraulic cylinders 102 and 104 pivotally extending between the blade 44 and the transversal beam 56. The pistons of the hydraulic cylinders 102 and 104 are anchored on the upper surface of the blade 44 in socket housing 106 and 108. Upon actuation of the hydraulic cylinders 102 and 104, the angle G of the grade can be adjusted around the hub 98 according to various factors such as the speed of the truck, the material graded and the quantity of the material graded.

Figure 12:
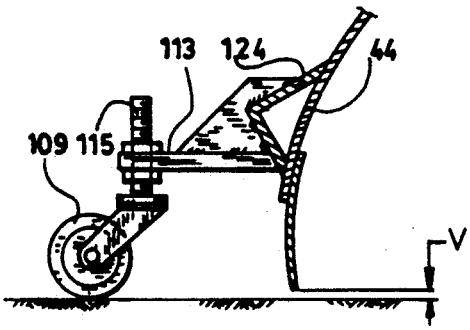
FIG. 12 is a side view of a swivel wheel mounted on the blade.

It also contemplated to provide the blade with swivel wheel arrangement 107 at both lower ends of the blade such as shown in FIG. 10 to prevent the lower edge of the blade to ride on undesirable surfaces such as when the grader travels over a short distance on a cement or an asphalt road. Such arrangement 107 includes a swivel wheel 109 adapted to be lowered whenever needed. As more specifically illustrated in FIG. 12, the swivel wheel 109 is rearwardly fixed on the blade 44 on an angular brace plate 113 secured to the blade 44. The wheel 109 is vertically adjustable by a threaded rod 115 and adapted to be lowered below the level of the lower edge of the blade 44 to define a gap V with the ground. The height of the gap is particularly adjusted for the removal of snow or ice to prevent damaging the pavement itself or any structure such as manhole covers.

The grader according to the invention is also contemplated to be used with a sand or salt blasting device which extends over the grader and which is adapted to project sand or salt behind the latter after the grader has cleaned the road. The blasting device, which may be generally conventional, includes a chute 114 which receives the sand or salt from the truck 10 and extends behind the grader 14. The chute 114 brings the salt or sand to a rotating wheel 116 actuated by a motor 118. During the rotation of the wheel 116, the sand or salt is projected on the road, that is, on the surface of the ground 46 behind the grader according to the invention. A deflector 120 extends from the chute between the wheel 116 and the grader in order to prevent the blasted material to be projected on the grader. Such a combination is particularly interesting and suitable when the grader has cleaned the snow over the ground and sand or salt needs to cover the icy surface of the road. The combined operation of the grader and the blasting device allows the sand and the salt to be applied on the graded surface of the road and accordingly allows it to be more effective. Otherwise, the spreading of sand or salt over a surface which starts to be covered by snow is not as effective than when applied directly on icy surface contacting the road.

A pair of eyelets 111 are secured over the arms 40 for allowing the grader to be removed from the truck. The grader is pulled away from the truck by hoisting cables secured to the eyelets 111 by simply removing the pins 30 which allows the plate 24 to tilt backwardly and subsequently the plate 24 is lifted away from the lateral rods 20 by the hoisting cables, consequently allowing to seperate the grader from the truck.

In a rear mounted grader, the blade 44, which is preferably concave, has a tendency to straighten when scraping the ground. In order to prevent such straightening effect and even to reduce possible vibrations, a pair of triangular ribs 124 and 126 are welded on the convex side of the blade 44. Rib 124 extends along the full length of the blade for maintaining the concave shape of the latter where the traction is stronger, while rib 126 reinforces the blade across the central portion of the blade which supports the arms 40.

I claim:

1. A rear mounted grader for a vehicle having a frame extending behind a pair of rear wheels of said vehicle, said grader comprising, a plate member adapted to be vertically secured to said vehicle frame behind said wheels, a pair of rearwardly extending arms pivotally mounted on said plate member for vertically moving relative to said plate member, sliding member mounted between said arms, said sliding member adapted to move parallel to said arms and to vertically move said arms, a blade transversally disposed relative to said arms and secured thereunder, a hydraulic piston pivotally secured at one end to said plate member above said pair of arms, and to said sliding member at the end opposite said one end for raising and lowering said blade from a position above the ground to an abutting position with the ground, whereby, upon actuation of said piston, said blade is adapted to selectively abut against the ground for grading the ground or be lifted therefrom.

2. A rear mounted grader for vehicle as recited in claim 1, comprising spring blades mounted behind said sliding member on top of said pair of arms, a pair of bumpers mounted on top of the rear ends of said pair of arms, said spring blades abutting against said pair of bumpers to allow the blade to resiliently abut the ground when the piston lowers the blade against the ground.

3. A rear mounted grader for vehicle as recited in claim 2, wherein said plate member comprises a first vertical plate secured to said vehicle frame, a second plate pivotally supported on said first plate at the lower end thereof, means for locking said second plate against said first plate, said second plate being provided with lateral slot parallel to said plates, a cross-bar pivotally mounted on said second plate and extending through said slots, said arms being secured to said cross-bar and adapted to pivot with said cross-bar in a plane parallel to the second plate, whereby said blade is adapted to tilt sideways according to the lateral difference in level of the ground.

4. A rear mounted grader for vehicle as recited in claim 3, including two transversal beams securely extending between said arms, a pair of longitudinal beams securely extending between said transversal beams, said longitudinal beams defining a slit therebetween, said sliding member comprising a I-beam mounted through said slit, a ball joint member secured over said I-beam for connecting said piston to said I-beam.

5. A rear mounted grader for vehicle as recited in claim 4, including a stopper device adapted to maintain said arms at a fixed angle relative to said second plate, said stopper device comprising a rod pivotally mounted over one of said arms, adjacent said second plate, said rod adapted to pivot between said one arm and said stopper device for stopping said arms at said fixed angle when said blade is raised.

6. A rear mounted grader for vehicle as recited in claim 1, including a sand blasting device adapted to be secured to a truck above said grader, said blasting device comprising a chute for receiving sand from said vehicle, said chute extending behind said grader, a dispersing device for projecting the sand towards the ground behind said grader, whereby the ground is adapted to be covered by sand immediately after the passage of the grader.

7. A rear mounted grader for vehicle as recited in claim 4, wherein said blade is concave, on the side adapted to face the vehicle, a pair of reinforcing ribs welded across said blade on its convex side, said ribs adapted to maintain the concave shape of the blade and to prevent its vibration.

* * * * *